US010598416B2

(12) United States Patent
Hellmann

(10) Patent No.: US 10,598,416 B2
(45) Date of Patent: Mar. 24, 2020

(54) REFRIGERATION CIRCUIT WITH OIL SEPARATION

(71) Applicant: Carrier Corporation, Farmington, CT (US)

(72) Inventor: Sascha Hellmann, Rheinzabern (DE)

(73) Assignee: CARRIER CORPORATION, Palm Beach Gardens, FL (US)

( * ) Notice: Subject to any disclaimer, the term of this patent is extended or adjusted under 35 U.S.C. 154(b) by 408 days.

(21) Appl. No.: 15/026,122

(22) PCT Filed: Nov. 4, 2013

(86) PCT No.: PCT/EP2013/072952
§ 371 (c)(1),
(2) Date: Mar. 30, 2016

(87) PCT Pub. No.: WO2015/062676
PCT Pub. Date: May 7, 2015

(65) Prior Publication Data

US 2016/0238294 A1 Aug. 18, 2016

(51) Int. Cl.
*F25B 43/02* (2006.01)
*F25B 41/04* (2006.01)

(52) U.S. Cl.
CPC ..... *F25B 43/02* (2013.01); *F25B 41/04* (2013.01); *F25B 2400/075* (2013.01);
(Continued)

(58) Field of Classification Search
CPC .... F25B 43/02; F25B 41/04; F25B 2400/075; F25B 2400/23; F25B 2700/03; F25B 2700/1932
See application file for complete search history.

(56) References Cited

U.S. PATENT DOCUMENTS 2,665,557 A 1/1954 Dodson
3,070,977 A * 1/1963 Kimmel ..... F25B 43/02 62/473

(Continued)

FOREIGN PATENT DOCUMENTS

DE 112008003384 T5 10/2010
DE 102012100720 A1 8/2012

(Continued)

OTHER PUBLICATIONS

International Search Report for application PCT/EP2013/072952, dated Mar. 6, 2014, 4 pages.

*Primary Examiner* — Henry T Crenshaw
*Assistant Examiner* — Kamran Tavakoldavani
(74) *Attorney, Agent, or Firm* — Cantor Colburn LLP

(57) ABSTRACT

A refrigeration cycle (1) comprises in the direction of flow of a circulating refrigerant: a compressor unit (2); an oil separation device (4) which is configured for separating oil from an refrigerant-oil-mixture leaving the compressor unit (2); at least one gas cooler/condenser (6); and at least one evaporator (10) having an expansion device (8) connected upstream thereof. The oil separation device (4, 5) comprises: a refrigerant inlet line connected to the compressor unit (2), the refrigerant inlet line having at least a first portion (12) with a first diameter (d1); a refrigerant conduit arranged downstream of and connected to the refrigerant inlet line, the refrigerant conduit having at least a second portion (14) with a second diameter (d2), which is larger than the first diameter (d1); a refrigerant outlet line arranged downstream of and connected to the refrigerant conduit, the refrigerant outlet line having at least a third portion (16) with a third diameter (d3), which is smaller than the second diameter (d2); and an oil suction line (20) having an inlet portion (22) which opens into the second portion (14) and is configured for sucking oil from the second portion (16). The third (Continued)

Figure 1:
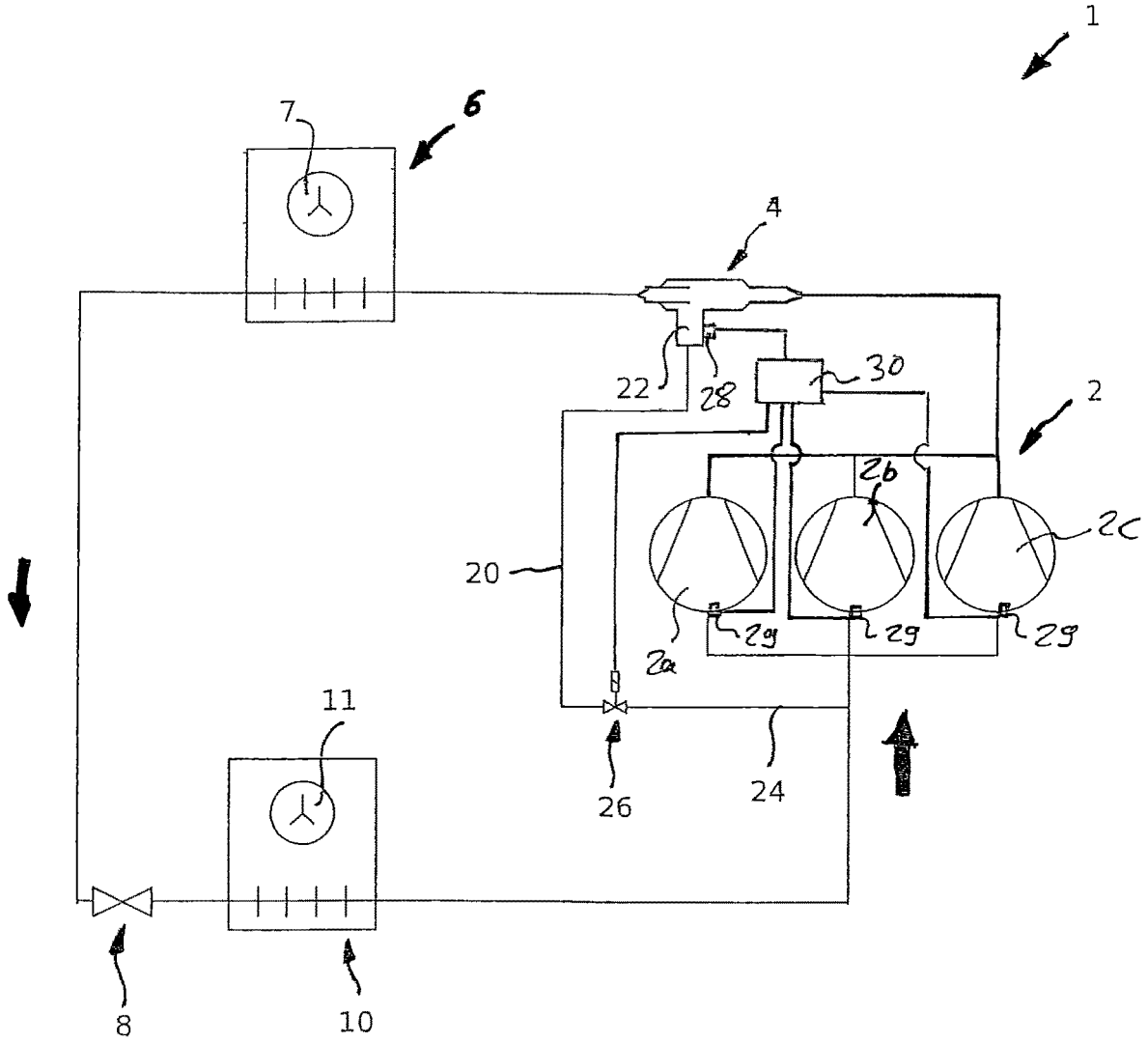

portion (16) having the third diameter (d2) extends into the second portion (14) forming an oil separation pocket (18) between the outer diameter of the third portion (16) and the inner diameter of the second portion (14).

8 Claims, 2 Drawing Sheets

(52) U.S. Cl.
CPC ..... *F25B 2400/23* (2013.01); *F25B 2500/01* (2013.01); *F25B 2600/2515* (2013.01); *F25B 2700/03* (2013.01); *F25B 2700/1932* (2013.01)

(56) References Cited

U.S. PATENT DOCUMENTS

| | | | | |
|---|---|---|---|---|
| 3,283,532 | A | 11/1966 | Kocher | |
| 3,360,958 | A | 1/1968 | Miner | |
| 4,254,637 | A | 3/1981 | Brauch et al. | |
| 4,472,949 | A | 9/1984 | Fujisawa et al. | |
| 4,478,050 | A * | 10/1984 | DiCarlo | F04B 39/16 62/193 |
| 4,887,514 | A | 12/1989 | Schintgen | |
| 4,895,498 | A | 1/1990 | Basseggio | |
| 5,001,908 | A | 3/1991 | Mayer | |
| 5,634,345 | A | 6/1997 | Alsenz | |
| 5,636,974 | A | 6/1997 | Ikeda et al. | |
| 5,694,780 | A | 12/1997 | Alsenz | |
| 6,347,528 | B1 * | 2/2002 | Iritani | B60H 1/00357 62/323.1 |
| 9,021,830 | B2 | 5/2015 | Etter et al. | |
| 2009/0071188 | A1 | 3/2009 | Kusada et al. | |
| 2010/0126211 | A1 * | 5/2010 | Okamoto | F25B 31/004 62/470 |
| 2011/0203304 | A1 | 8/2011 | Sato et al. | |
| 2012/0291464 | A1 * | 11/2012 | Yoon | F25B 31/004 62/126 |

FOREIGN PATENT DOCUMENTS

| | | | |
|---|---|---|---|
| DE | 102012215621 | A1 | 3/2013 |
| DE | 102011056903 | A1 | 6/2013 |
| EP | 0438251 | A1 | 7/1991 |
| EP | 0971129 | A2 | 1/2000 |
| EP | 1130261 | A2 | 9/2001 |
| EP | 1160448 | A1 | 12/2001 |
| EP | 1167762 | A2 | 1/2002 |
| EP | 1515047 | A2 | 3/2005 |
| EP | 1857676 | A2 | 11/2007 |
| EP | 1895160 | A2 | 3/2008 |
| EP | 1909048 | A1 | 4/2008 |
| EP | 2000672 | A1 | 12/2008 |
| EP | 2025936 | A1 | 2/2009 |
| EP | 2388448 | A1 | 11/2011 |
| EP | 2466230 | A2 | 6/2012 |
| JP | 2006266618 | A | 10/2006 |
| WO | 2009009728 | A2 | 1/2009 |
| WO | 2009091403 | A1 | 7/2009 |
| WO | 2009149726 | A1 | 12/2009 |
| WO | 2011050428 | A1 | 5/2011 |
| WO | 2011084369 | A2 | 7/2011 |

* cited by examiner

REFRIGERATION CIRCUIT WITH OIL SEPARATION

Refrigeration circuits comprising in the direction of flow of a circulating refrigerant a compressor, a gas cooler/condenser, an expansion device and an evaporator are known in the state of the art.

In operation lubricant, which is used for lubricating the compressor, transfers from the compressor's oil sump into the circulating refrigerant distributing the lubricant over the refrigeration circuit and reducing the level of lubricant within the oil sump.

Accordingly, it would be beneficial to provide suitable means for recovering the lubricant in order to be transferred back to the compressor's oil sump.

A refrigeration circuit according to an exemplary embodiment of the invention, which is configured for circulating a refrigerant, comprises in the direction of flow of the refrigerant: a compressor unit with at least one compressor; an oil separation device, which is configured for separating oil from an refrigerant-oil-mixture leaving the at least one compressor; at least one gas cooler/condenser; an expansion device; and at least one evaporator. The oil separation device comprises:

- a refrigerant inlet line connected to the at least one compressor, the refrigerant inlet line having at least a first portion with a first diameter;
- a refrigerant conduit arranged downstream of and connected to the refrigerant inlet line, the refrigerant conduit having at least a second portion with a second diameter being larger than the first diameter;
- a refrigerant outlet line arranged downstream of and connected to the refrigerant conduit, the refrigerant outlet line having at least a third portion with a third diameter being smaller than the second diameter;
- wherein the third portion extends into the second portion forming an oil separation pocket between the outer diameter of the third portion and the inner diameter of the second portion; and
- an oil suction line having an inlet portion which opens into the second portion and is configured for receiving oil from the second portion.

In a refrigeration cycle according to an exemplary embodiment of the invention, which comprises an oil separation device located between the compressor unit and the gas cooler/condenser, lubricant, which has transferred from the compressor's oil sump to the circulating refrigerant is separated from said refrigerant and may be transferred back to the compressor(s) in order to continuously ensure sufficient lubrication of the compressor(s).

Figure 2:
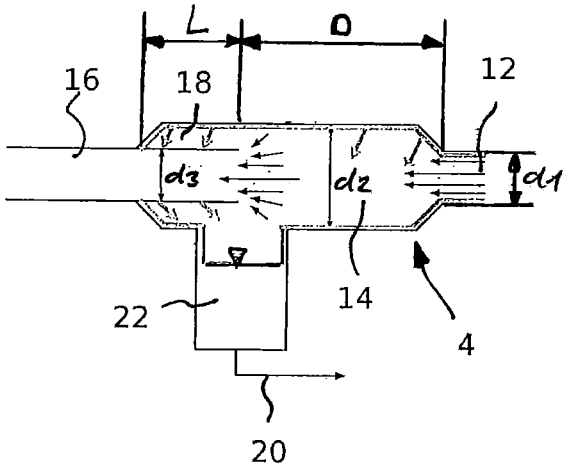
Figure 3:
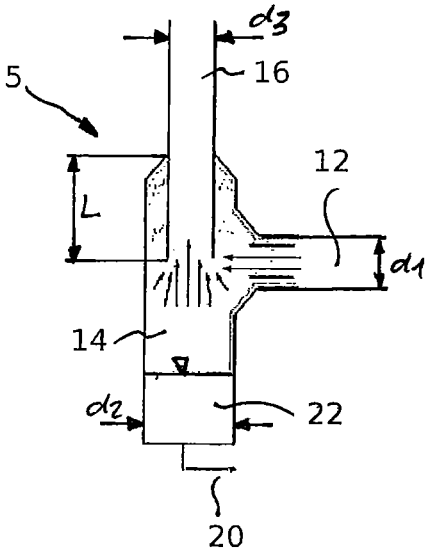

An exemplary embodiment of the invention is described in greater detail below with reference to the figures, wherein:

FIG. 1 shows a schematic view of a refrigeration circuit according to an exemplary embodiment of the invention; and FIG. 2 shows a schematic sectional view of an oil separation device according to a first exemplary embodiment of the invention; and FIG. 3 shows a schematic sectional view of an oil separation device according to a second exemplary embodiment of the invention.

FIG. 1 shows a schematic view of an exemplary embodiment of a refrigeration circuit 1 comprising in the direction of the flow of a refrigerant circulating within the refrigeration circuit 1 as indicated by the arrows a set 2 of compressors 2*a*, 2*b*, 2*c* connected in parallel to each other, an oil separation device 4, a gas cooler/condenser 6, an expansion device 8, which is configured for expanding the refrigerant, and an evaporator 10. The outlet side of the evaporator 10 is fluidly connected to the suction (inlet) side of the compressor unit 2 completing the refrigerant cycle. The gas cooler/condenser 6 and/or the evaporator 10 may be provided with at least one fan 7, 11, respectively, in order to enhance the transfer of heat from/to the refrigerant provided by the cooler/condenser 6 and/or the evaporator 10.

Although the exemplary embodiment shown in FIG. 1 comprises only a single gas cooler/condenser 6, a single expansion device 8 and a single evaporator 10, respectively, it is evident to the skilled person that a plurality of each of said components 6, 8, 10 respectively connected in parallel to each other may by provided in order to enhance the condensing and/or cooling capacity. In this case additional switchable valves may be provided, as well, in order to allow selectively activating and deactivating one or more of the plurality of said components in order to adjust the condensing and/or cooling capacity to the actual needs.

Similarly, only a single compressor may be provided instead of the set 2 of a plurality of compressors 2*a*, 2*b*, 2*c* as it is shown in FIG. 1. Said single compressor or at least one of the plurality of compressors 2*a*, 2*b*, 2*c* may be a compressor 2*a*, which is able to operate with variable speed allowing to control the cooling capacity provided by the refrigeration circuit 1 by controlling the speed of said variable speed compressor 2*a*.

A receiver (not shown) may be arranged between the gas cooler/condenser 6 and the expansion device 8 in order to store excessive refrigerant. In case of providing a receiver an additional expansion device (not shown) may be arranged between the outlet side of the gas cooler/condenser 6 and the receiver providing a two-stage expansion, which may be beneficial under certain operational conditions.

In operation the compressed refrigerant leaving the set 2 of compressors 2*a*, 2*b*, 2*c* enters into the oil separation device 4. In the oil separation device 4 lubricant, in particular lubricating oil, which is present in the refrigerant leaving the set 2 of compressors 2*a*, 2*b*, 2*c*, is separated from the refrigerant and may be transferred via an oil suction line 20, which is connected between an oil outlet port of the oil separation device 4 and the low pressure inlet side of the compressor unit 2, back to the oil sumps of the compressors 2*a*, 2*b*, 2*c*. A switchable valve 26, e.g. a solenoid valve 26, is provided within the oil suction line 20. In its closed state the switchable valve 26 provides a barrier between the compressor unit's 2 low pressure (suction) side and the compressor unit's 2 high pressure (outlet) side. A control unit 30 opens the switchable valve 26 when a sufficient amount of oil has been collected in the oil suction line's 20 inlet portion 22 in order to transfer the collected oil to the inlet side/oil sump(s) of the compressor unit 2.

A liquid level sensor 28 may be provided at the suction line's 20 inlet portion 22 for detecting the level of oil, which has been collected within the suction line's 20 inlet portion 22. Alternatively, the switchable valve 26 may be opened after a predetermined time of operation of at least one of the compressors 2*a*, 2*b*, 2*c* or based on the oil differential pressure.

Additionally or alternatively the compressors 2*a*, 2*b*, 2*c* may be respectively provided with a liquid level sensor 29 which is configured to detect the level of oil within the respective compressor's crank case in order to open the switchable valve 26 when the level of oil in at least one of the compressors 2*a*, 2*b*, 2*c* drops below a preset value.

An enlarged sectional view of a first embodiment of an oil separation device 4 is shown in FIG. 2.

The exemplary embodiment of an oil separation device 4, which is shown in FIG. 2, comprises a first portion 12 which is part of a refrigerant pressure conduit fluidly connected to the outlet side of the compressor unit 2 (which is not shown in FIG. 2).

Said first portion 12 has a first diameter d1 and is fluidly connected to a refrigerant expansion conduit having at least a second portion 14 having a second diameter d2, which is larger than the first diameter d1 of the first portion 12.

A refrigerant outlet line is arranged downstream of and connected to the second portion 14, the refrigerant outlet line having at least a third portion 16 having a third diameter d3, which is smaller than the second diameter d2. In the embodiment shown in FIG. 2 the third diameter d3 is equal to the first diameter d1 of the first portion 12, but it is also possible that the third diameter d3 differs from the first diameter d1.

The third portion 16 in particular extends over a length L into the second portion 14 opposite to the first portion 12 forming an oil separation pocket 18 between the outer diameter of the third portion 16 and the larger inner diameter of the second portion 14.

As the velocity of the refrigerant flow within a conduit decreases in radial direction from the center of the conduit to its outer periphery, a substantial portion of the oil comprised in the circulating refrigerant accumulates at the side wall(s) of the second portion 14, when refrigerant comprising oil enters from the first portion 12 into the enlarged second portion 14 and decreases its velocity of flow due to the enlarged diameter of the second portion 14.

As said oil accumulates at the outer periphery of the second portion 14, the central part of the refrigerant flow entering into the third portion 16, which is aria ranged at a central part of the second portion 14 in radial direction and which has a smaller diameter d3 than the second portion 14, comprises considerably less oil than the refrigerant entering from the first portion 12.

The minimum length of the enlarged second portion 14 in direction of the flow is defined by the minimum distance of flow necessary for providing a satisfactory oil separation. The distance D between an upstream end of the enlarged second portion 14 and an upstream end of the third portion 16 may for example be in the range of 0.25 m to 1 m, in particular 0.5 m.

The first, second and third portions 12, 14, 16 may be formed by pipes or conduits which have a circular cross section and are arranged co-axially with each other along a common axis A. Said axis A may be oriented horizontally, as shown in FIGS. 1 and 2, allowing to provide oil separation within a horizontally oriented refrigerant line without the need for much additional space in particular in the vertical direction. Thus, when an oil separation device 4 as it is shown in FIGS. 1 and 2 is used, it is not necessary to provide an oblique refrigerant line having a minimum inclination for allowing oil-liquid separation. This provides much flexibility when designing the refrigeration circuit.

The diameters d1, d3 of the first and third portions 12, 16 may by one of the following dimensions: 11 mm, 15 mm, 18 mm, 22 mm, 28 mm, 35 mm, 42 mm, 54 mm, 64 mm; and the diameter d2 of the second portion 14 may be two dimensions lager than the first diameter d1, e.g.: d1=11 mm, d2=18 mm; d1=15 mm, d2=22 mm; etc.

In order to transfer the oil, which has been collected in the oil separation pocket 18 formed between the second and third portions 14, 16, out of said oil separation pocket 18, an inlet portion 22 of an oil suction line 20 opens into a bottom of said second portion 14.

In consequence, oil, which has collected in the oil separation pocket 18, will flow driven by means of gravity from the second portion 14 into the inlet portion 22 of the oil suction line 20. As soon as the level of oil, which has been collected within the inlet portion 22 of the oil suction line 20, exceeds a predetermined level, which may be detected by means of an oil level sensor 28 arranged at the inlet portion 22 of the oil suction line 20, the switchable valve 26, which is arranged in the oil suction line 20, is opened fluidly connecting the inlet portion 22 of the oil suction line 20 to the low pressure inlet side of the compressor unit 2, and the oil, which has been collected within the inlet portion 22 of the oil suction line 20, is driven by the high pressure provided at the compressors' 2*a*, 2*b*, 2*c* outlet side into the compressors' 2*a*, 2*b*, 2*c* inlet side.

FIG. 3 shows schematic sectional view of an oil separation device 5 according to a second embodiment. While in the first embodiment, as it is shown in FIGS. 1 and 2, the first, second and third portions 12, 14, 16 extend basically parallel, in particular coaxially to each other, in said second embodiment the first (inlet) portion 12 extends basically perpendicularly to the second and third portions 14, 16 extending parallel to each other.

In particular, the first portion extends basically horizontally and enters at an intermediate height into the second portion 14, which extends basically vertically. The third portion 16 is introduced basically vertically into the second portion 14 from its top and the inlet portion 22 of the oil suction line 20 is formed by the bottom of the second portion 14.

In other words, the second embodiment shown in FIG. 3 is basically formed from the first embodiment, as it is shown in FIG. 2, by rotating the oil separation device 90° in clockwise direction around an axis which extends perpendicular to the plane of the figures and interchanging the functionality of the first (refrigerant inlet) portion 12 and the inlet portion 22 of the oil suction line 20. As it occupies less space in the horizontal direction than the first embodiment, the oil separation device 5 according to the second embodiment, as it is shown in FIG. 3, may by advantageous in situations in which the space, which is available in the horizontal direction, is limited.

In an oil separation device having the claimed structure the oil is separated from the refrigerant due to a reduction of the refrigerant's velocity of flow caused by increasing the cross section of the refrigerant pressure line connected to the outlet side of the compressor(s). Due to the increased cross section the velocity of flow may be reduced by approximately 50%, e.g. from 9 to 14 m/s at the outlet of the compressor(s) to approximately 4.5 to 7 m/s within the widened refrigerant conduit. The separated oil collects at the outer periphery of the conduit and is delivered back to the compressor(s). As the oil is separated in the pressure line downstream of the compressor(s) and upstream of the gas cooler/condenser, the distribution of oil over a large portion of the refrigeration cycle, in particular collection of oil within the gas cooler/condenser, is avoided. In consequence the amount of oil, which is necessary in order to reliably ensure sufficient lubrication of the compressor(s), is reduced and a reduction of the gas cooling/condensing capacity of the gas cooler/condenser due to oil collected within the gas cooler/condenser is avoided.

An oil separation device having the claimed simple structure is easy to produce at low costs and has a small configuration, which facilitates the installation of said oil separation device within the refrigeration cycle.

In an embodiment the oil suction line has an outlet portion fluidly connected to a low pressure suction side of the compressor unit allowing the compressor unit to suck oil from the oil suction line.

In an embodiment a switchable valve is arranged between the inlet portion and the outlet portion of the oil suction line allowing to maintain different pressure levels between the inlet portion and the outlet portion when the switchable valve is closed and allowing the transfer of oil from the inlet portion to the outlet portion by opening the switchable valve.

In an embodiment the refrigeration circuit further comprises a control unit which is configured for controlling the switchable valve. The refrigeration circuit may further comprise a liquid level sensor configured for detecting the level of oil which has been collected within the suction line's inlet portion. The liquid level sensor may be connected to the control unit allowing to control the switchable valve based on the level of oil which has been collected within the suction line's inlet portion.

In an embodiment at least one of the first, second and third portions is arranged substantially horizontally, allowing the separation of oil from the refrigerant flowing through a conduit which is oriented substantially horizontally.

In an embodiment at least one of the first, second and third portions is arranged substantially vertically, allowing the separation of oil from the refrigerant flowing through a conduit which is oriented substantially vertically.

In an embodiment the first, second and third portions are arranged substantially co-axially to each other. A co-axially arrangement, in particular of portions having a circular diameter, is easy to produce at low costs.

In an embodiment at least one of the first, second and third portions is arranged substantially perpendicular with respect to at least one of the other portions, allowing the separation of oil from the refrigerant to be made in a corner portion of the conduit, which may be advantageous for conveniently arranging the oil separation device within the refrigeration circuit.

In an embodiment the oil separation device is arranged such that the oil separation pocket is arranged at a higher position than the first portion, and particularly such that the direction of flow of the refrigerant within the second portion is substantially opposite to the force of gravity. Such an orientation may enhance the separating capabilities of the separation device.

In an embodiment the inlet portion of the oil suction line opens to a lower (bottom) portion of the refrigerant conduit allowing oil to flow from the refrigerant conduit into the oil suction line driven by means of gravity.

An exemplary method of operating a refrigeration cycle according to exemplary embodiments of the invention comprises the step of controlling a switchable valve arranged between the oil separation device and the inlet side of the compressor unit in order to temporarily allow oil to flow from the oil separation device to the inlet side and/or oil sump(s) of the compressor unit.

The method may comprise the steps of detecting the level of oil, which has been collected within the suction line's inlet portion and controlling the switchable valve based on the detected level of oil.

Alternatively or additionally the switchable valve may be controlled based on the time of operation of at least one compressor, the level of oil within the compressors, in particular a compressor's crank case, and/or the differential oil pressure.

While the invention has been described with reference to exemplary embodies it will be understood by those skilled in the art that various changes may be made and equivalence may be substitute for elements thereof without departing from the scope of the invention. In addition, modifications may be made to adapt a particular situation or material to the teachings of the invention without departing from the essential scope thereof. Therefore, it is intended that the invention is not limited to the particular embodiments disclosed, but that the invention will include all embodiments falling within the scope of the pendent claims.

REFERENCE NUMERALS

1 refrigeration circuit
2 compressor unit
2*a*, 2*b*, 2*c* compressors
4, 5 oil separation device
6 gas cooler/condenser
7 gas cooler/condenser fan
8 expansion device
10 evaporator
11 evaporator fan
12 first portion
14 second portion
16 third portion
18 oil separation pocket
20 oil suction line
22 inlet portion of the oil suction line
24 outlet portion of the oil suction line
26 switchable valve
28, 29 liquid level sensor
30 control unit

The invention claimed is:

1. A refrigeration cycle comprising in the direction of flow of a circulating refrigerant:

a compressor unit comprising at least one compressor;

an oil separation device which is configured for separating oil from a refrigerant-oil-mixture leaving the compressor unit;

at least one gas cooler/condenser;

at least one expansion device; and at least one evaporator;

wherein the oil separation device comprises:

a refrigerant inlet line connected to the compressor unit, the refrigerant inlet line having at least a first portion with a first diameter (d1);

a refrigerant conduit arranged downstream of and connected to the refrigerant inlet line, the refrigerant conduit having at least a second portion with a second diameter (d2), which is larger than the first diameter (d1);

a refrigerant outlet line arranged downstream of and connected to the refrigerant conduit, the refrigerant outlet line having at least a third portion with a third diameter (d3), which is smaller than the second diameter (d2);

wherein the first, second and third portions are arranged co-axially to each other; and wherein the third portion having the third diameter (d3) extends into the second portion forming an oil separation pocket between the outer diameter of the third portion and the inner diameter of the second portion; and an oil suction line having an inlet portion which opens into the second portion and is configured for receiving oil from the second portion and an outlet portion which is fluidly connected to a low pressure suction side of the compressor unit;

wherein the refrigeration cycle further comprises:

a switchable valve arranged between the inlet portion and the outlet portion of the oil suction line and;

a controller which is configured for controlling the switchable valve based on the oil differential pressure.

2. The refrigeration cycle of claim 1, wherein at least one of the first, second and third portions is arranged horizontally.

3. The refrigeration cycle of claim 1, wherein the oil separation device is arranged such that the oil separation pocket is arranged at a higher position than the first portion.

4. The refrigeration cycle of claim 3, wherein the oil separation device is arranged such that the direction of flow of the refrigerant is opposite to the force of gravity.

5. The refrigeration cycle of claim 1, wherein at least one of the first, second and third portions is arranged vertically.

6. The refrigeration cycle of claim 1, wherein the inlet portion of the oil suction line opens to a lower portion of the refrigerant conduit.

7. A method of operating a refrigeration cycle of claim 1 comprising controlling the switchable valve to selectively allow oil to flow from the oil separation device to the inlet side of the compressor unit; detecting the level of oil, which has been collected within the suction line's inlet portion and controlling the switchable valve based on the detected level of oil and/or controlling the switchable valve based on the oil differential pressure.

8. A refrigeration cycle comprising in the direction of flow of a circulating refrigerant:

a compressor unit comprising at least one compressor;

an oil separation device which is configured for separating oil from a refrigerant-oil-mixture leaving the compressor unit;

at least one gas cooler/condenser;

at least one expansion device; and at least one evaporator;

wherein the oil separation device comprises:

a refrigerant inlet line connected to the compressor unit, the refrigerant inlet line having at least a first portion with a first diameter (d1);

a refrigerant conduit arranged downstream of and connected to the refrigerant inlet line, the refrigerant conduit having at least a second portion with a second diameter (d2), which is larger than the first diameter (d1);

a refrigerant outlet line arranged downstream of and connected to the refrigerant conduit, the refrigerant outlet line having at least a third portion with a third diameter (d3), which is smaller than the second diameter (d2);

wherein the first, second and third portions are arranged co-axially to each other; and wherein the third portion having the third diameter (d3) extends into the second portion forming an oil separation pocket between the outer diameter of the third portion and the inner diameter of the second portion; and an oil suction line having an inlet portion which opens into the second portion and is configured for receiving oil from the second portion and an outlet portion which is fluidly connected to a low pressure suction side of the compressor unit;

wherein the refrigeration cycle further comprises:

a switchable valve arranged between the inlet portion and the outlet portion of the oil suction line;

a liquid level sensor which is configured for detecting the level of oil, which has been collected within the suction line's inlet portion; and a controller which is configured for controlling the switchable valve based on the level of oil within the suction line's inlet portion measured by the liquid level sensor.

* * * * *